US005615745A

United States Patent [19]

Cross

[11] Patent Number: 5,615,745

[45] Date of Patent: Apr. 1, 1997

[54] ATV LIFT HANDLE RUB BLOCK

[75] Inventor: Gary Cross, Estherville, Iowa

[73] Assignee: Cycle Country Accessories Corp., Milford, Iowa

[21] Appl. No.: 662,045

[22] Filed: Jun. 12, 1996

[51] Int. Cl.[6] ..... E01H 5/04; E02F 3/00

[52] U.S. Cl. ..... 172/811; 172/776; 37/231; 37/266; 37/270; 37/466; 180/313

[58] Field of Search ..... 172/811, 815, 172/824, 825, 683, 684.5, 776; 37/231, 266, 214, 219, 270, 271, 407, 410, 466, 903; 180/313

[56] References Cited

U.S. PATENT DOCUMENTS

| | | | |
|---|---|---|---|
| Re. 26,010 | 5/1966 | Rubin | 37/270 X |
| 293,620 | 2/1884 | Birch | 37/270 X |
| 345,257 | 7/1886 | Priest | 37/270 X |
| 1,695,635 | 12/1928 | Duffield | 172/684.5 |
| 1,710,110 | 4/1929 | Penny | 172/684.5 X |
| 2,063,537 | 12/1936 | Beard | 172/684.5 X |
| 2,104,675 | 1/1938 | Ruff | 172/684.5 |
| 2,279,869 | 4/1942 | Houston | 172/811 |
| 2,455,692 | 12/1948 | McDunnah | 37/231 X |
| 2,761,226 | 9/1956 | Solem | 172/684.5 X |
| 3,422,553 | 1/1969 | Holloway | 37/231 |
| 3,548,956 | 12/1970 | Hochstetler | 172/811 X |
| 3,566,976 | 3/1971 | Heersink | 172/776 X |
| 4,630,686 | 12/1986 | Ausmus, Jr. | 172/684.5 X |
| 4,825,570 | 5/1989 | Schmid et al. | 37/231 |
| 4,836,320 | 6/1989 | Sundin | 37/270 X |
| 4,890,400 | 1/1990 | Long | 172/815 X |
| 4,962,599 | 10/1990 | Harris | 37/266 |
| 5,088,215 | 2/1992 | Ciula | 37/266 X |

FOREIGN PATENT DOCUMENTS

| | | | |
|---|---|---|---|
| 822625 | 11/1951 | Germany | 172/683 |
| 885075 | 8/1953 | Germany | 37/270 |
| P9719111/45A | 5/1956 | Germany | 172/683 |

*Primary Examiner*—Terry Lee Melius
*Assistant Examiner*—Christopher J. Novosad
*Attorney, Agent, or Firm*—Zarley, McKee, Thomte, Voorhees & Sease; Dennis L. Thomte

[57] ABSTRACT

An all terrain vehicle having a vertically movable blade at the forward end thereof is described wherein the vertical movement of the blade is controlled by a lift handle positioned rearwardly thereof and which is pivotally mounted on a lift handle bracket. The lift handle has a locking pin mounted thereon which is positioned rearwardly of the rearward end of the lift handle bracket when the blade is in its raised position. When it is desired to lower the blade, the lift handle is pivotally moved with respect to the lift handle bracket to disengage the locking pin with respect to the rear end of a lift handle bracket. A rub block is positioned on the outer surface of the lift handle bracket for engagement with the lift handle to prevent the locking pin from wearing or cutting a groove in the lift handle bracket.

6 Claims, 4 Drawing Sheets

ATV LIFT HANDLE RUB BLOCK

BACKGROUND OF THE INVENTION

1. Field of the Invention

This invention relates to an all terrain vehicle (ATV) and more particularly to a lift handle rub block used in conjunction with an ATV having a vertically movable blade at the forward end thereof.

2. Description of the Related Art

All terrain vehicles (ATV's) have met with increased popularity during the last few years. The ATV's have been used for cultivating, plowing, disking, plowing snow, etc. In connection with the use of the ATV for plowing snow, dirt, etc., a vertically movable blade is mounted at the forward end of the ATV. Many ATV's have vertically movable blades at the forward end thereof, such blades being operatively connected to a lift handle which is positioned at one side of the ATV so that the operator of the ATV may raise and lower the blade as required. In many applications, the blade at the forward end of the ATV has a bell crank apparatus connected thereto which includes a rearwardly extending lift rod which is connected to a lift handle so that the operator may pull the lift handle rearwardly to raise the blade and may move the lift handle forwardly to allow the blade to lower into engagement with the dirt, snow, etc. In many cases, the lift handle is pivotally mounted on a lift handle bracket which is secured to the ATV. The lift handle, in many cases, has a locking pin extending therefrom which engages the rearward end of the lift handle bracket to yieldably lock the lift handle in its rearward position so that the blade is maintained in its raised position. When the lift handle is moved between its rearward and forward positions or locked and unlocked positions, the locking pin rubs along the outer surface of the lift handle bracket and will eventually wear through the lift handle bracket.

SUMMARY OF THE INVENTION

The rub block device of this invention is designed to be used with an all terrain vehicle having a selectively vertically movable blade at the forward end thereof. The blade has a lift arm extending rearwardly therefrom which is connected to a lift handle pivotally mounted on the lift handle bracket. The lift handle has a locking pin extending inwardly therefrom which is adapted to engage the rearward end of the lift handle bracket, when the lift handle is in its rearward position, to yieldably maintain the blade in its raised condition. A rub block or rub button extends outwardly from the lift handle bracket and is designed to engage the lift handle, during the pivotal movement of the lift handle with respect to the lift handle bracket, to limit the amount of engagement of the locking pin with respect to the lift handle bracket.

It is therefore a principal object of the invention to provide an improved lift handle for an ATV.

Still another object of the invention is to provide an ATV lift handle rub block.

Still another object of the invention is to provide a means for preventing the locking pin of a lift handle from wearing through the lift handle bracket upon which it is mounted.

These and other objects will be apparent to those skilled in the art.

DESCRIPTION OF THE PREFERRED EMBODIMENT

Figure 1:
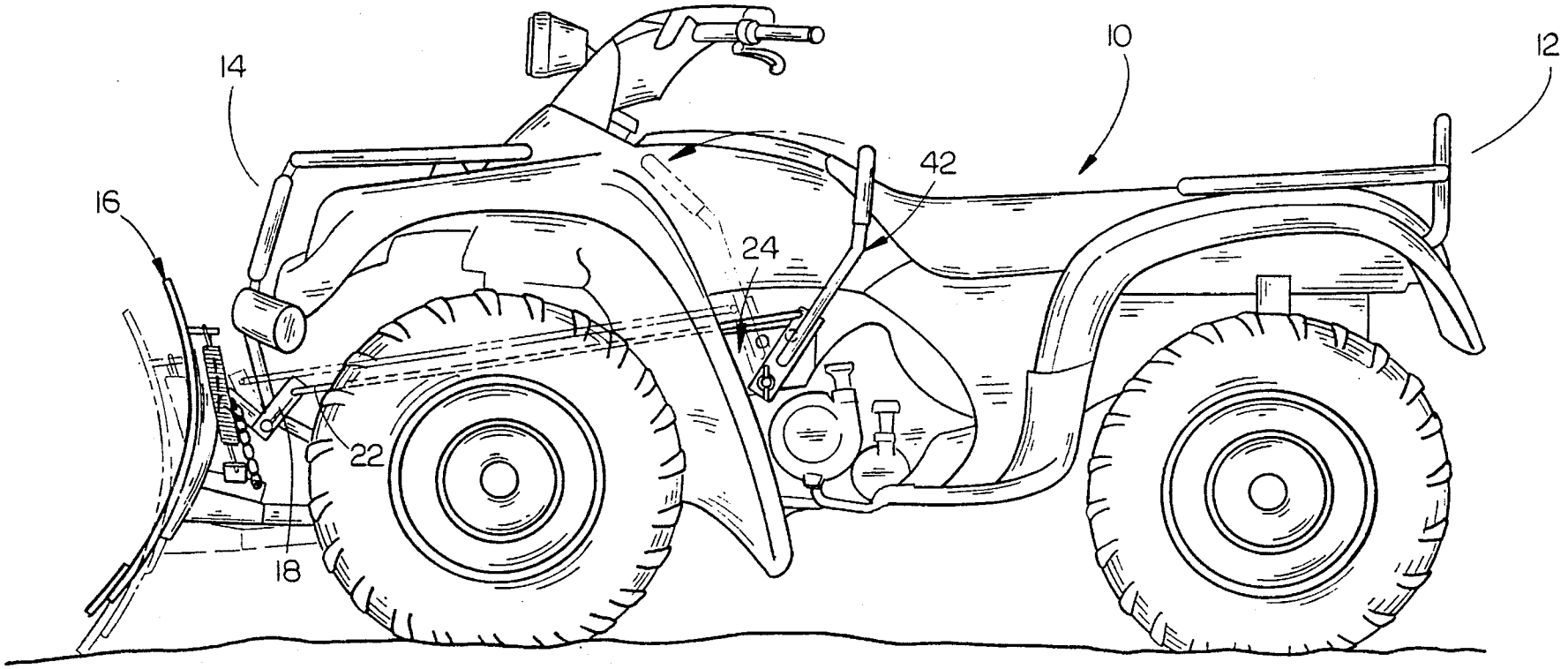
FIG. 1 is a side elevational view of an all terrain vehicle having the device of this invention mounted thereon.

In FIG. 1, the numeral 10 refers generally to a self-propelled vehicle such as an all terrain vehicle (ATV) having a rearward end 12 and a forward end 14. ATV 10 includes a conventional vertically movable blade assembly 16 at its forward end having a conventional bell crank 18 operatively secured thereto for raising and lowering the blade with respect to the ground 20. The numeral 22 refers to a lift arm which has its forward end pivotally connected to the bell crank device 18 and which extends rearwardly therefrom.

The numeral 24 refers to a conventional lift handle bracket which is secured to one side of the ATV 10 by bolts or the like and which has a forward end 26, rearward end 28, upper end 30 and lower end 32. Lift arm bracket 24 also will be described as having an outer surface 34. Bolt or stud 36 extends outwardly from the outer surface 34 of lift handle bracket 24 and is adapted to receive a spring 38 thereon as well as a wing nut 40.

The numeral 42 refers to a conventional lift handle having an upper end 44 and a lower end 46. Plate 48 is welded to the lower end of lift handle 42 and forms a part of the lift handle 42. Plate 48 has an opening 50 formed therein adjacent its upper end which is adapted to receive the rearward end of lift arm 22. Plate 48 also has an opening 52 formed therein adjacent its lower end which is adapted to receive the stud 36. Further, lift handle 42 includes a conventional locking pin 54 which extends inwardly from the inner surface 56 of plate 48. Spring 38 is positioned outwardly of plate 56 and is retained thereon by wing nut 40 to permit plate 48 and lift handle 42 to pivot with respect to stud 36 and also to permit the upper end, and locking pin 54, to be selectively moved outwardly with respect to the lift handle bracket 24 as desired.

Figure 3:
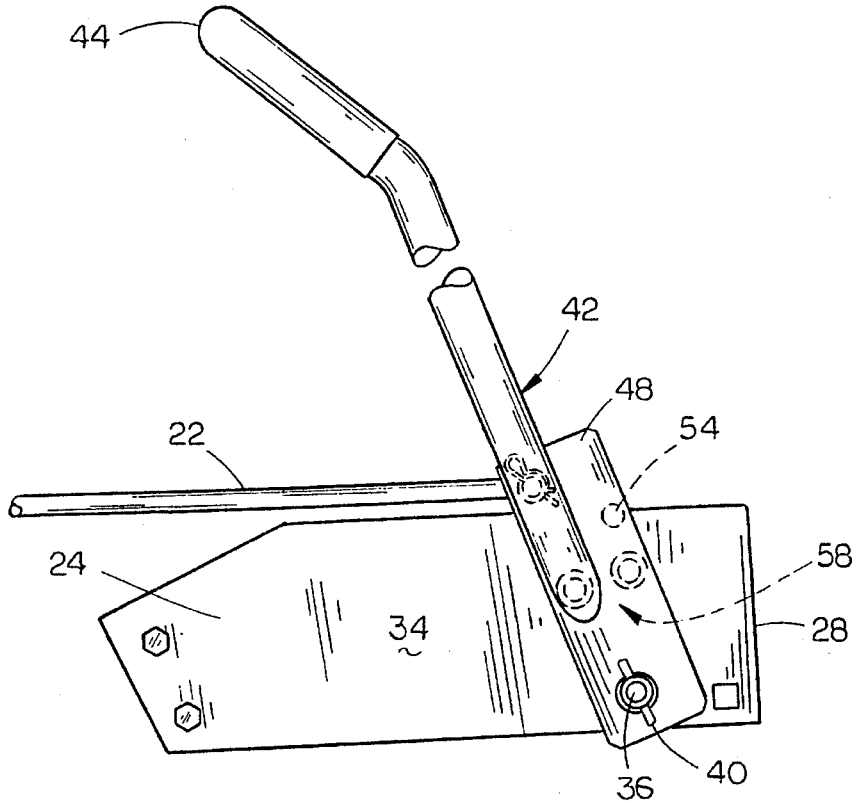
FIG. 3 is a view similar to FIG. 2 except that the lift handle has been moved from its rear locked position to its forward position.
Figure 4:
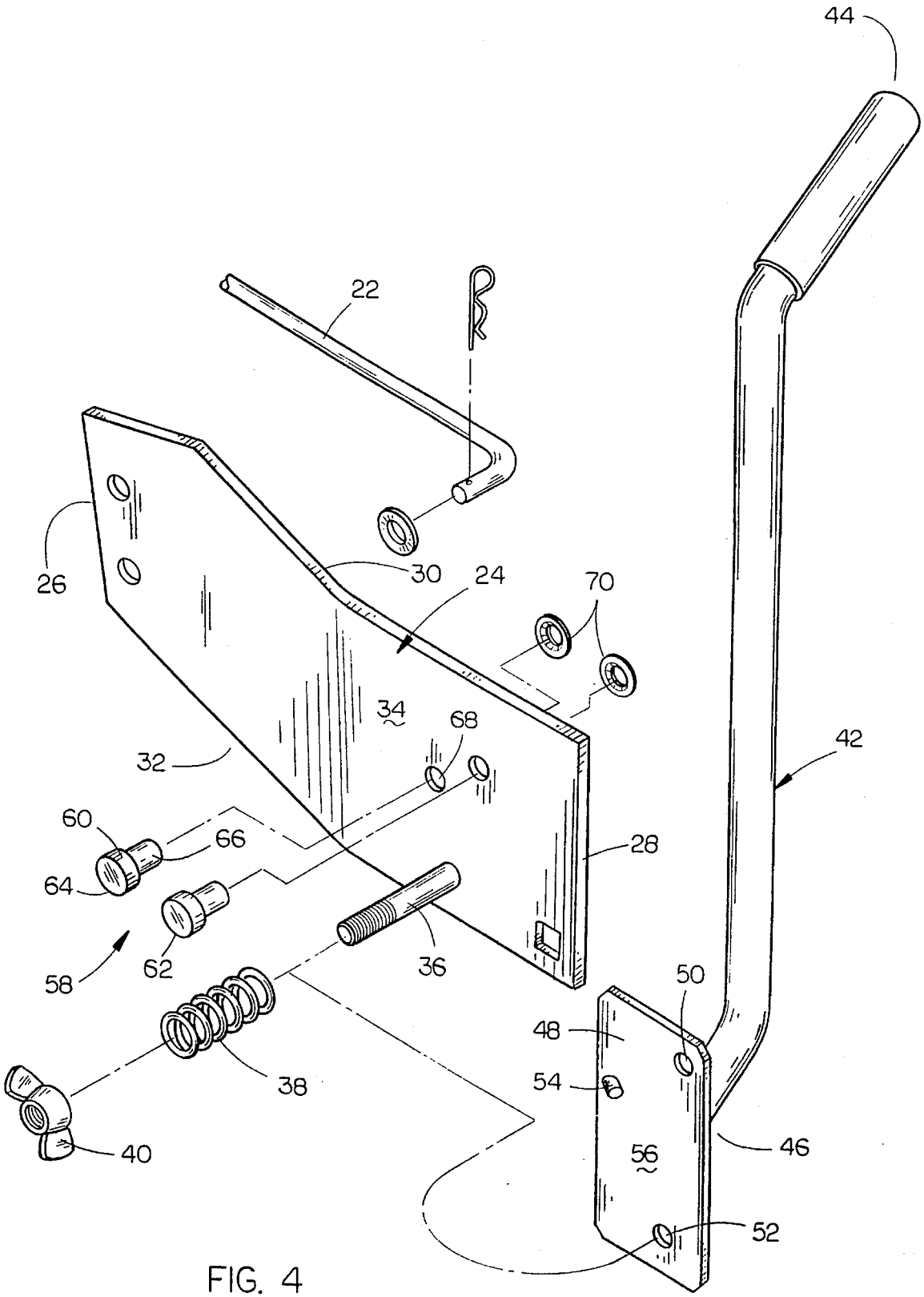
FIG. 4 is an exploded perspective view of the device of this invention.
Figure 5:
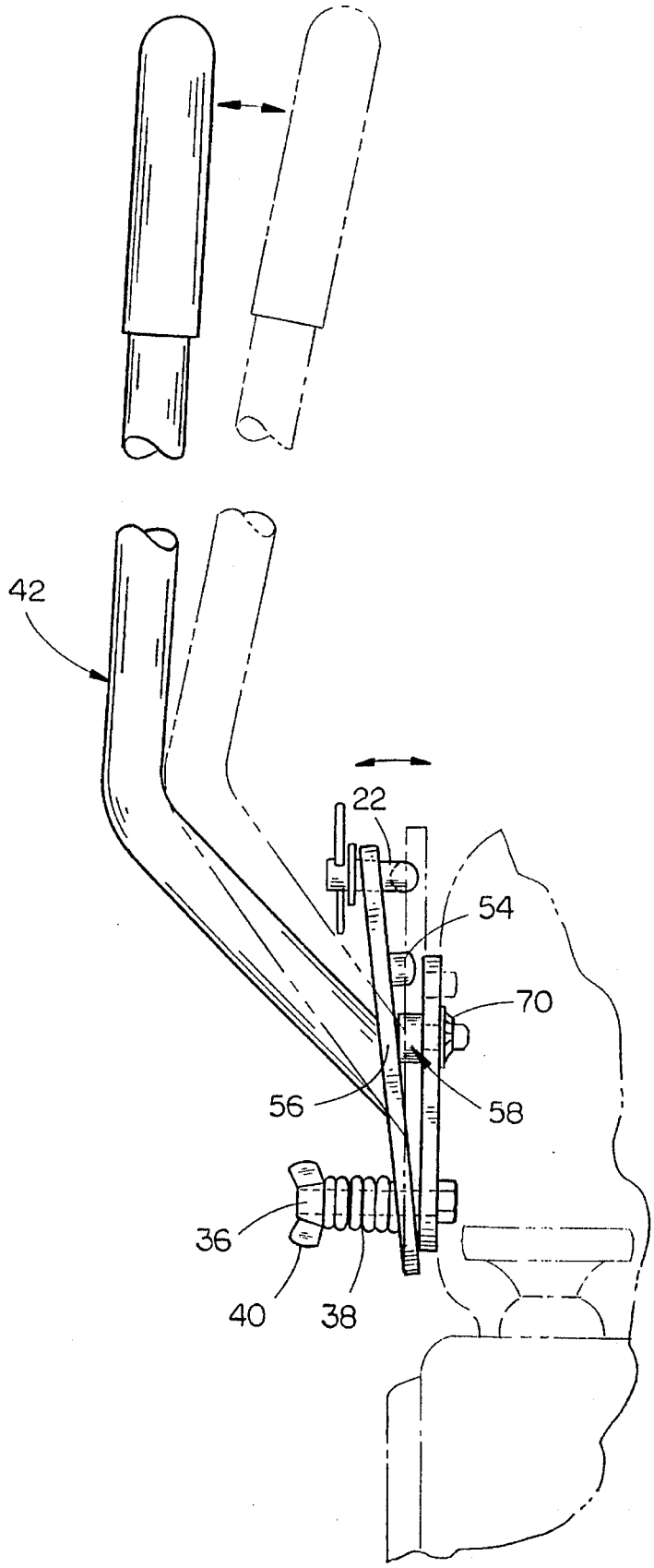
FIG. 5 is a rear elevational view of the invention.

The structure described heretofore is conventional. The lift handle 42 is designed to be positioned in that position shown in FIG. 2 wherein the locking pin 54 is positioned rearwardly of the rear end 28 of lift handle bracket 34, and in engagement therewith, to maintain the blade 16 in its upper position. When it is desired to lower the blade 16 from its upper position to its lower position, the upper end of the lift handle 42 is moved outwardly with respect to the lift handle bracket 24 so that locking pin 54 may be moved outwardly with respect to the lift handle bracket 24. The lift handle 42 is then moved from the position of FIG. 2 to the position of FIG. 3 to enable the blade 16 to be lowered into ground engagement with the dirt or snow. However, during the movement of the lift handle 42 from the position of FIG. 2 to the position of FIG. 3 and the movement of the lift handle 42 from the position of FIG. 3 to the position of FIG. 4, the inner end of the locking pin 54 normally engages the exterior surface of the lift handle bracket 24 and eventually wears through the lift handle bracket 24. It is for that purpose that the rub block of this invention has been provided which is generally referred to by the reference numeral 58.

Preferably, rub block 58 comprises one or more rub blocks or buttons 60 and 62 preferably comprised of a plastic material such as Teflon or the like. Each of the buttons or rub blocks 60 and 62 include a head portion 64 which is positioned at the outer surface 34 of lift handle bracket 24 and a shank portion 66 which extends through an opening 68 formed in lift handle bracket 24. A retainer washer 70 engages the inner end of the shank 68 of each rub block 60 to maintain the rub block in position.

Figure 2:
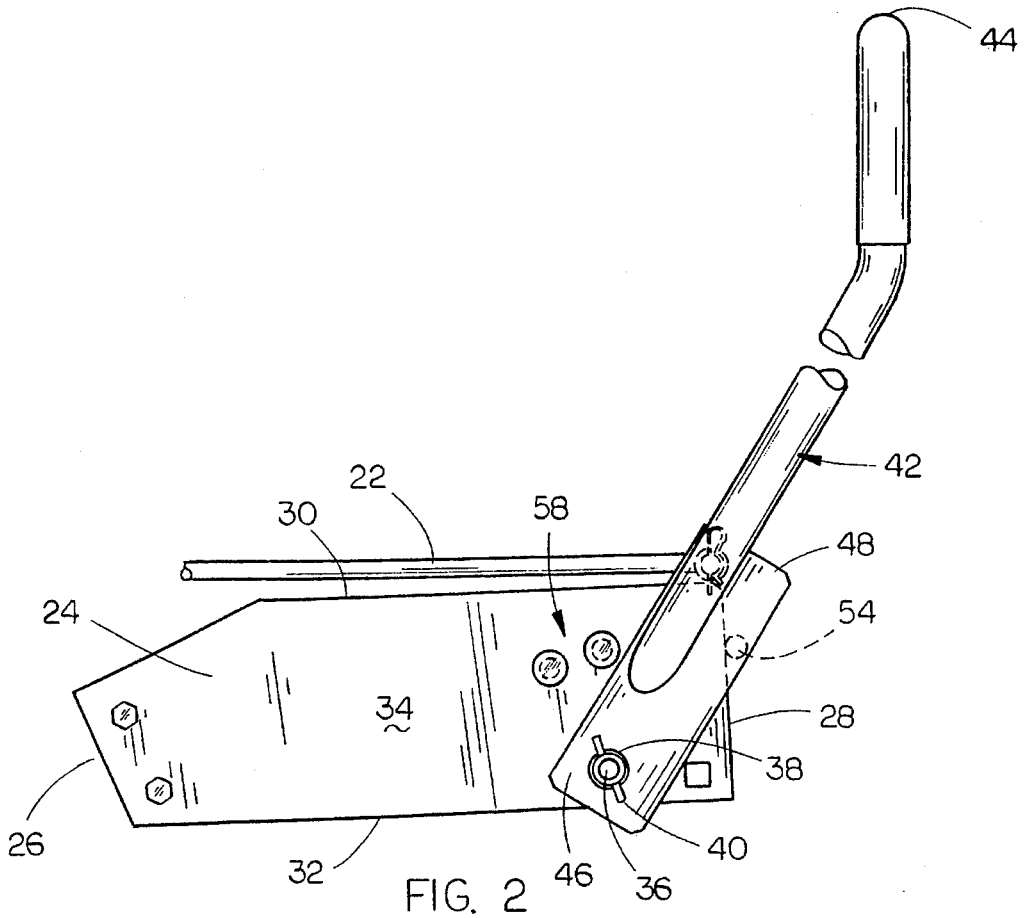
FIG. 2 is a side elevational view of the device of this invention.

FIG. 2 illustrates the lift handle 42 in its rearward position wherein the locking pin 54 is positioned rearwardly of the rearward end 28 of lift handle bracket 24 to yieldably maintain the blade 16 in its raised position. When it is desired to lower the blade from its raised position to its lowered position, the upper end of lift handle 42 is pivotally moved outwardly with respect to lift handle bracket 24, against the resistance of spring 38, so that locking pin 54 is moved out of engagement with the rearward end of the lift handle bracket 24. The lift handle 42 is then pivotally moved from the position of FIG. 2 to the position of FIG. 3 so that the blade 16 is lowered with respect to the ATV 10. During the pivotal movement of the lift handle 42 from the position of FIG. 2 to the position of FIG. 3 and vice versa, the rub blocks 60 and 62 engage the inner surface of the plate 48 to limit the amount of engagement of the inner end of the locking pin 54 with the exterior surface 34 of the lift handle bracket 24, thereby preventing the locking pin 54 from cutting a groove through the lift handle bracket 24.

Thus it can be seen that the above-described invention accomplishes at least all of its stated objectives.

I claim:

1. In combination:

a self-propelled vehicle having a forward end, a rearward end, and opposite sides;

a blade selectively vertically movably mounted at the forward end of said vehicle and being movable between raised and lowered positions;

a lift handle bracket secured to said vehicle at one side thereof rearwardly of said blade;

said lift handle bracket having inner and outer surfaces, a rearward end and a forward end;

an upstanding lift handle, having upper and lower ends, positioned adjacent the outer surface of said lift handle bracket and being pivotally secured thereto;

said lift handle being pivotally movable, with respect to said lift handle bracket, between a rear position and a forward position;

pivot means connecting said lift handle to said lift handle bracket;

a linkage operatively connecting said lift handle to said blade whereby said blade is positioned in its said raised position when said lift handle is positioned in its said rear position and whereby said blade is positioned in its said lowered position when said lift handle is positioned in its said forward position;

a locking pin extending from said lift handle towards said lift handle bracket;

said locking pin being positioned rearwardly of said rearward end of said lift handle bracket, and being in engagement therewith, when said lift handle is in its said rear position to yieldably prevent said lift handle from moving to its said forward position;

spring means mounted on said pivot means for yieldably urging said lift handle towards said lift handle bracket to permit said lift handle to be yieldably moved away from said lift handle bracket to permit said locking pin to be moved out of engagement with said rearward end of said lift handle bracket when it is desired to move said lift handle to its said forward position;

and a rub block means positioned on the outer surface of said lift handle bracket for engagement with said lift handle, as said lift handle is moved with respect to said lift handle bracket, to limit the engagement of said locking pin with said outer surface of said lift handle bracket.

2. The combination of claim 1 wherein said rub block means comprises at least one button means extending outwardly from said lift handle bracket.

3. The combination of claim 1 wherein said rub block means comprises at least a pair of buttons extending outwardly from said lift handle bracket.

4. The combination of claim 1 wherein said rub block means is comprised of a plastic material.

5. The combination of claim 1 wherein said rub block means is comprised of a Teflon material.

6. A lift handle bracket assembly for use with a self-propelled vehicle, said vehicle having a forward end, a rearward end, and opposite sides; a blade selectively vertically movably mounted at the forward end of said vehicle and being movable between raised and lowered positions; said vehicle including a linkage operatively connected to said blade for raising and lowering said blade with respect to said vehicle, comprising:

a lift handle bracket secured to said vehicle at one side thereof rearwardly of said blade;

said lift handle bracket having inner and outer surfaces, a rearward end and a forward end;

an upstanding lift handle, having upper and lower ends, positioned adjacent the outer surface of said lift handle bracket and being pivotally secured thereto;

said lift handle being pivotally movable, with respect to said lift handle bracket, between a rear position and a forward position;

pivot means connecting said lift handle to said lift handle bracket;

said lift handle being operatively connected to said linkage whereby said blade is positioned in its said raised position when said lift handle is positioned in its said rear position and whereby said blade is positioned in its said lowered position when said lift handle is positioned in its said forward position;

a locking pin extending from said lift handle towards said lift handle bracket;

said locking pin being positioned rearwardly of said rearward end of said lift handle bracket, and being in engagement therewith, when said lift handle is in its said rear position to yieldably prevent said lift handle from moving to its said forward position;

spring means mounted on said pivot means for yieldably urging said lift handle towards said lift handle bracket to permit said lift handle to be yieldably moved away from said lift handle bracket to permit said locking pin to be moved out of engagement with said rearward end of said lift handle bracket when it is desired to move said lift handle to its said forward position;

and a rub block means positioned on the outer surface of said lift handle bracket for engagement with said lift handle, as said lift handle is moved with respect to said lift handle bracket, to limit the engagement of said locking pin with said outer surface of said lift handle bracket.

* * * * *